US006036391A

United States Patent [19]

Holliday et al.

[11] Patent Number: 6,036,391

[45] Date of Patent: Mar. 14, 2000

[54] HAND-HELD APPLICATOR FOR APPLYING A CLEANING OR POLISHING SOLUTION TO A SURFACE

[75] Inventors: Brian Holliday, Danbury; Paul Metaxatos, Collinsville; David Mathieu, Middletown, all of Conn.

[73] Assignee: Prestone Products Corporation, Danbury, Conn.

[21] Appl. No.: 08/994,979

[22] Filed: Dec. 19, 1997

[51] Int. Cl.[7] ..... A46B 11/02; B05C 1/06

[52] U.S. Cl. ..... 401/188 R; 401/184

[58] Field of Search ..... 401/188 R, 188 A, 401/187, 153, 146, 184, 185

[56] References Cited

U.S. PATENT DOCUMENTS

| | | | |
|---|---|---|---|
| 233,238 | 10/1880 | Halbert . | |
| D. 249,928 | 10/1978 | De Nijs . | |
| D. 339,918 | 10/1993 | Chamberlain . | |
| 595,910 | 12/1897 | Fili, Jr. . | |
| 1,208,623 | 12/1916 | Nakashima . | |
| 2,204,200 | 6/1940 | Wisner . | |
| 2,770,828 | 11/1956 | Ellman | 401/146 |
| 2,886,916 | 5/1959 | Rossi . | |
| 3,256,894 | 6/1966 | Sherman . | |
| 4,077,083 | 3/1978 | Siemund et al. . | |
| 4,077,725 | 3/1978 | Slautterback . | |
| 4,085,475 | 4/1978 | Silver . | |
| 4,139,124 | 2/1979 | Ferrante | 401/188 R |
| 4,315,342 | 2/1982 | Ash . | |
| 4,325,499 | 4/1982 | Shay . | |
| 4,351,081 | 9/1982 | Tarkinson . | |
| 4,381,766 | 5/1983 | Avolio . | |
| 4,390,324 | 6/1983 | Karliner . | |
| 4,486,109 | 12/1984 | Rosofsky . | |
| 4,507,004 | 3/1985 | Moffitt, Jr. . | |
| 4,543,680 | 10/1985 | Vlahos . | |
| 4,546,903 | 10/1985 | Burch . | |
| 4,674,903 | 6/1987 | Chen . | |
| 4,738,887 | 4/1988 | Govertsen . | |
| 4,750,233 | 6/1988 | Swain . | |

(List continued on next page.)

FOREIGN PATENT DOCUMENTS

| | | | |
|---|---|---|---|
| 212157 | 3/1924 | United Kingdom | 401/184 |
| 913371 | 12/1962 | United Kingdom | 401/188 |
| 2232075 | 12/1990 | United Kingdom | 401/184 |

*Primary Examiner*—Charles R. Eloshway
*Attorney, Agent, or Firm*—Frommer Lawrence & Haug LLP

[57] ABSTRACT

A hand-held applicator for applying a cleaning or polishing solution to a surface including a container housing for containing a cleaning or polishing solution, such as cleaning agents, protectants, waxes, soaps, detergents, etc. Moreover, in this applicator, a discharge valve assembly controls the flow of the cleaning or polishing solution from the container housing. A pump assembly is connected to the container housing which increases the pressure within the container housing so as to release a portion of the liquid product through the discharge valve assembly. The pump assembly includes a bellows-like chamber communicating with the container housing by means of an air opening slit at an end thereof extending into the container housing. A pump actuating member is provided which compresses the bellows-like chamber upon manual force applied thereto to thereby open the air opening slit to admit air into the container housing to increase the pressure thereof so as to open the discharge valve assembly and release a portion of the liquid product from the container housing onto the surface. A solution application pad applies the liquid product released through the discharge valve assembly by a cleaning or polishing action thereof upon the surface.

28 Claims, 9 Drawing Sheets

U.S. PATENT DOCUMENTS 4,811,445 3/1989 Lagieski et al. .
4,861,180 8/1989 Adams ..... 401/188 R
4,896,799 1/1990 Giuffredi .
4,955,747 9/1990 Tarver .
4,961,661 10/1990 Sutton et al. ..... 401/184
4,966,481 10/1990 Satten et al. .
4,970,750 11/1990 Davis, III .
4,993,859 2/1991 Assad et al. .
5,003,659 4/1991 Paepke .
5,020,694 6/1991 Pettengill .
5,020,930 6/1991 Kuhn .
5,031,448 7/1991 Saito .
5,038,963 8/1991 Pettengill et al. .
5,073,057 12/1991 Lathrop et al. .
5,099,541 3/1992 Tressler .
5,289,949 3/1994 Gentile .
5,335,827 8/1994 Gentile .
5,387,290 2/1995 Kolinsky .
5,397,194 3/1995 Yuan et al. .
5,454,656 10/1995 Rowe .
5,454,660 10/1995 Sakurai et al. .
5,536,095 7/1996 Diamond ..... 401/146
5,645,193 7/1997 Gentile et al. .

16
26
23
20
31
30
40
44
10
106b
22
106a
107
100
46
25a
27
103
102
28
55
12
15
53
14

16
25a
22
40
23
35
37
33
29
30
31
39
25
26
A
10
106a
105
104
100
12
55

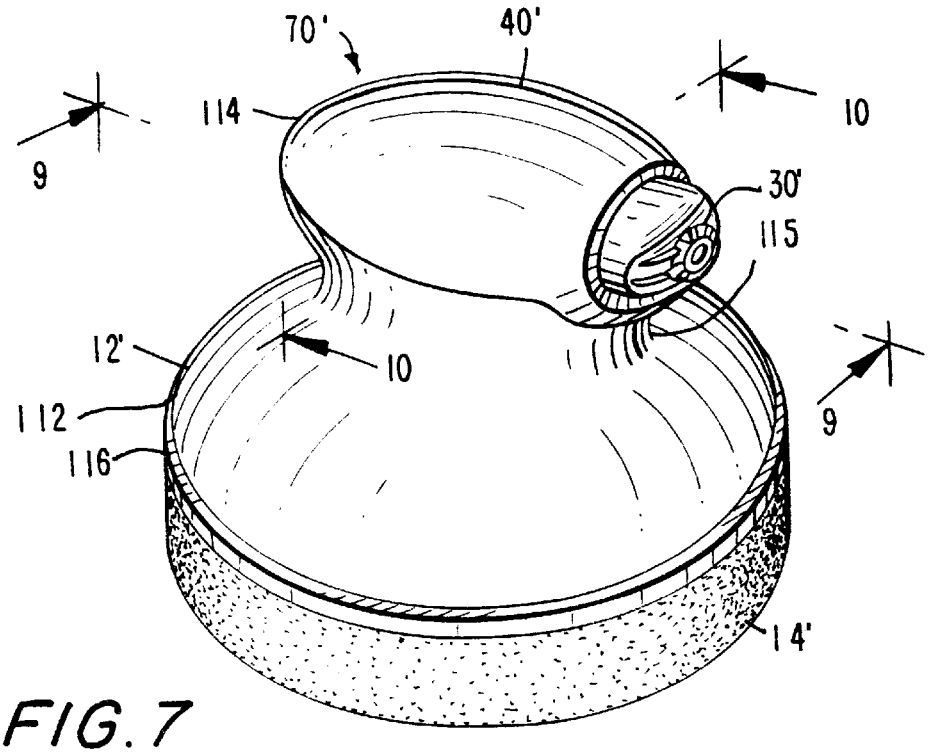
FIG. 7
FIG. 10
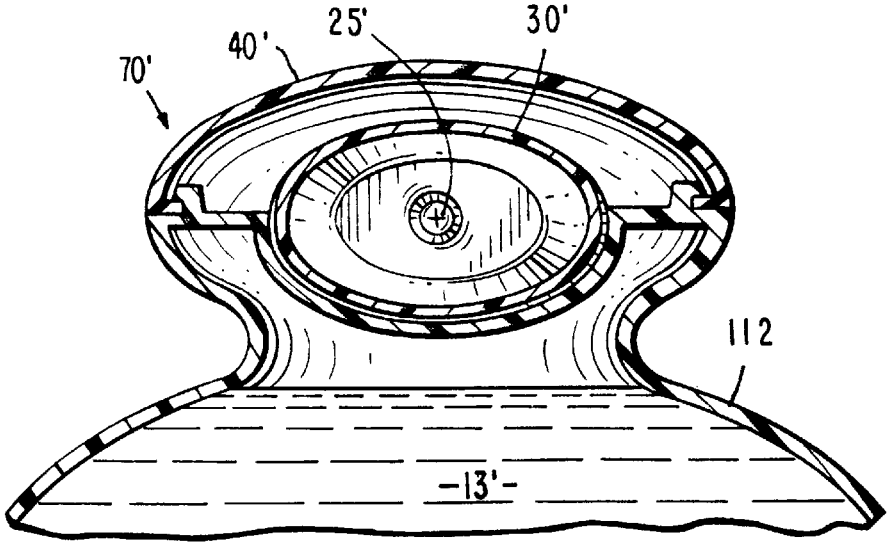

70'
114
132b
22'
140
142
30'
132a
112
115
72'
40'
44'
12
116
110
125d
125a
12
120
127
128
129
125b
125c
130
14'

HAND-HELD APPLICATOR FOR APPLYING A CLEANING OR POLISHING SOLUTION TO A SURFACE

FIELD OF THE INVENTION

The present invention generally relates to a hand-held applicator for applying a liquid product to a surface, and more particularly, the present invention relates to a hand-held applicator for dispensing a cleaning or polishing solution for hand-washing, polishing, or protecting surfaces of automobiles, glass, etc.

BACKGROUND OF THE INVENTION

As background, the present invention relates to a hand-held applicator for polishing, protecting, cleaning and/or waxing surfaces which includes a container housing for holding the cleaning or polishing solution and a solution applicator pad which applies the cleaning or polishing solution to the desired surface upon actuation of a valve assembly releasing the cleaning or waxing solution from the container housing to the solution applicator pad. Moreover, the present invention provides for manual control of the amount of cleaning or polishing solution which is applied to the desired surface thereby conserving the amount of cleaning or polishing solution utilized.

One use for the present invention is the application of polish or wax to a vehicle surface. In a basic hand-held arrangement to clean or polish a vehicle surface, a sponge is dipped by hand into a pail or tub (or poured from a bottle in liquid arrangement) which includes the cleaning or polishing solution. After the solution has been applied to the solution applicator pad, the solution is applied to the vehicle surface. These manual hand waxing/polishing techniques have been found to be disadvantageous as the amount of solution applied to the applicator pad or sponge is not readily controlled. Moreover, with these hand-held cleaning and polishing techniques, the user's hand typically comes into regular contact with the cleaning and/or polishing solution which can thereby lead to extreme dryness, skin irritation and roughness of the user's hands after extended use.

It has therefore been found desirable to provide handheld washing and/or polishing applicators which eliminate the need for the user's hand to come into contact with the cleaning or polishing solution. Moreover, it has been also found desirable to provide a hand-held applicator for cleaning and/or polishing solutions which dispenses a desired amount of solution to the surface to be cleaned or polished without waste thereof.

One attempted prior solution to these problems is disclosed in the fountain cleaning device of U.S. Pat. No. 5,397,194. In that fountain cleaning device, a reservoir is compressible in the direction perpendicular to the surface to be cleaned. A one-way flow control member allows the cleaning or polishing solution contained within the reservoir to be released to a solution applicator pad upon pressure release thereof. However, it has been found that fountain cleaning devices, such as that disclosed in U.S. Pat. No. 5,397,194, do not provide for sufficient control of the amount of cleaning or polishing solution which is applied to the cleaning or polishing surface and do not provide for the desired maneuverability of the cleaning device along the cleaning or polishing surface.

In order to aid in the maneuverability of such devices, cleaning and polishing devices containing the cleaning or polishing solution have been designed which incorporate an applicator pad in combination with a solution reservoir as in U.S. Pat. No. 5,387,290. In the hand polishing technique of U.S. Pat. No. 5,387,290, a washing pad is combined with a handle assembly such that the cleaning or polishing solution is applied over the vehicle body surface when a downward force is exerted on the fitted handle. However, although the cleaning and polishing device of U.S. Pat. No. 5,387,290 suggests an assembly wherein the user's hand does not come into contact with the cleaning or polishing solution, such a device does not control the flow of cleaning or polishing solution to the surface to be cleaned or polished. In addition, the cleaning or polishing agent must still be placed either on the wash surface of the polishing pad or directly on the vehicle surface body by some mechanism. Moreover, since a downward force must be applied to the washing pad to dispense the solution, in the polishing technique of U.S. Pat. No. 5,387,290, unwarranted solution may be dispensed if the user applies an unnecessary downward scrubbing force on the vehicle surface. Accordingly, it has been found desirable to provide a hand-held applicator for applying a cleaning or polishing solution to a surface wherein the solution contained in the container housing is released to a solution applicator pad upon manual pressurization of a pressure release valve extending between the container housing and the solution applicator pad.

OBJECTS OF THE INVENTION

It is therefore an object of the present invention to provide a hand-held applicator for applying a cleaning or polishing solution to a surface which avoids the deficiencies of the prior art.

It is also an object of the present invention to provide a hand-held applicator for applying a cleaning or polishing solution to a surface wherein the surface can be cleaned or polished without undue fatigue.

It is further an object of the present invention to provide an applicator for applying a cleaning or polishing solution to a surface which contains the cleaning or polishing solution in a self-contained housing and dispenses the cleaning or polishing solution onto a solution applicator pad as a result of manual pressure created in the container housing.

It is another object of the present invention to provide an applicator for applying a cleaning or polishing solution to a surface wherein the user's hand does not come into contact with the cleaning or polishing solution.

It is yet a further object of the present invention to provide an applicator for applying a cleaning or polishing solution to a surface which permits the surface to be cleaned or polished in multiple angular positions of the applicator.

It is yet another object of the present invention to provide an applicator for applying a cleaning or polishing solution to a surface which controls the amount of cleaning or polishing solution applied to the desired surface in order to avoid waste thereof.

It is still a further object of the present invention to provide an applicator for applying a cleaning or polishing solution to a surface which provides for ease in control of the maneuvering of the applicator along the cleaning or polishing surface.

It is yet another object of the present invention to provide an applicator for applying a cleaning or polishing solution to a surface which is convenient to use and reduces the time to clean or polish the surface as the cleaning or polishing solution can be dispensed simultaneously with cleaning or polishing.

It is still a further object of the present invention to provide an applicator for applying a cleaning or polishing solution to a surface which achieves a dripless unit.

It is yet another object of the present invention to provide an applicator for applying a cleaning or polishing solution to a surface which reduces the overall cost of such applicator.

Various other objects, advantages and features of the present invention will become readily apparent from the ensuing detailed description and the novel features will be particularly pointed out in the appended claims.

SUMMARY OF THE INVENTION

The present invention relates to a hand-held applicator for applying a cleaning or polishing solution to a surface which preferably includes a housing for containing the cleaning or polishing solution, a solution applicator pad, and a pump assembly which opens a valve assembly to thereby release the cleaning or polishing solution contained in the housing to the solution applicator pad or directly to the surface. As used herein, a "solution applicator pad" is defined as encompassing not only pad-like assemblies which include an absorbent material to absorb a liquid solution, but also a pad which can scrub a cleaning or polishing solution onto a surface, such as a brush or steel wool pad.

In this hand-held applicator, the housing contains a cleaning or polishing solution, such as a cleaning agent, a wax, a protectant, soap or detergent. A pump assembly is connected to the container housing and is capable of creating a pressure within the container housing for releasing a controlled portion of the cleaning or polishing solution from the container housing. This pump assembly is in the form of a bellows-like chamber communicating with the container housing through an air opening slit provided in an end thereof with the pump assembly being connected generally perpendicular to the container housing. A pump assembly actuating member in the form of a thumb depression member is connected to the pump assembly so as to extend generally horizontally therefrom. Therefore, if manual force is applied to the thumb depression member in a direction generally parallel to the desired surface, the bellows-like chamber will in turn be compressed such that the solution in the container housing will be pressurized. The pump assembly actuating member includes a sealing valve assembly at an end thereof to prevent air loss when the actuating member compresses the bellows-like chamber.

In one embodiment of this hand-held applicator, the solution applicator pad is attached to the container housing and is made of a sponge-like material. A discharge valve assembly communicates between the container housing and the solution applicator pad to restrict flow of the cleaning or polishing solution from the container housing to the solution applicator pad only when the pump assembly is actuated by manual force.

In addition, a cover member and associated collar member protects the pump assembly and actuator assembly therefore during use and maintains the pump and actuator in a generally perpendicular relation to the container body. The collar member is fitted over a neck portion of the container housing and includes retaining clip retaining members along the upper edge thereof for achieving a reliable snap fit of the cover member thereto.

Further, the container housing of the applicator of the present invention includes a neck portion for supporting the pump assembly and a contoured outer surface defining a grooved control region for the user's hand to facilitate the desired application of the cleaning or polishing solution to the surface. The container housing includes a central opening at a bottom surface thereof with the discharge valve assembly being fitted into the central opening to communicate with the interior of the container housing. In addition, the bottom surface of the container housing is slightly slanted from the outer edge thereof to the central opening to facilitate the flow of the cleaning or polishing solution contained in the container housing to the central opening. In this applicator, a base platform ring is snap-fit to the container housing to which the solution applicator pad is adhesively attached to the bottom surface thereof.

In operation, in the initial position of the applicator, of the sealing valve of the actuator member, the air opening slit of the bellows-like chamber and the discharge valve assembly are all in their closed condition. During the pump stroke, the pump assembly actuating member is pushed inwardly such that the bellow-like chamber is compressed to thereby open the air opening slit at the end thereof to admit air into the interior of the container housing to increase the pressure thereof. At the same time, the sealing valve at the end of the actuating member is in its closed sealing condition to prevent air pressure loss from the bellows-like chamber. As the pressure within the container housing increases, the discharge valve assembly opens such that the liquid or polishing solution is discharged from the container housing directly onto the surface to be cleaned or polished, or in some cases, onto the solution applicator pad. During the return stroke, the bellows-like chamber expands decreasing the pressure thereof to thereby close the air opening slit. As a result, the pressure within the container housing decreases so that the discharge valve assembly closes restricting flow of the cleaning or polishing solution from the container housing. In addition, the sealing valve of the actuating member is opened during the return stroke to assist in increasing the pressure within the bellows-like chamber.

BRIEF DESCRIPTION OF THE DRAWINGS

The following detailed description, given by way of example, but not intended to limit this invention solely to the specific embodiments described, may best be understood in conjunction with the accompanying drawings in which:

FIG. 7 is a front perspective view of another preferred embodiment of a hand-held applicator for applying a cleaning or polishing solution to a desired surface in accordance with the teachings of the present invention.

FIG. 10 is a side cross-sectional view of the applicator of FIG. 7 taken along line 10—10 of FIG. 7.

DETAILED DESCRIPTION OF CERTAIN PREFERRED EMBODIMENTS

Figure 1:
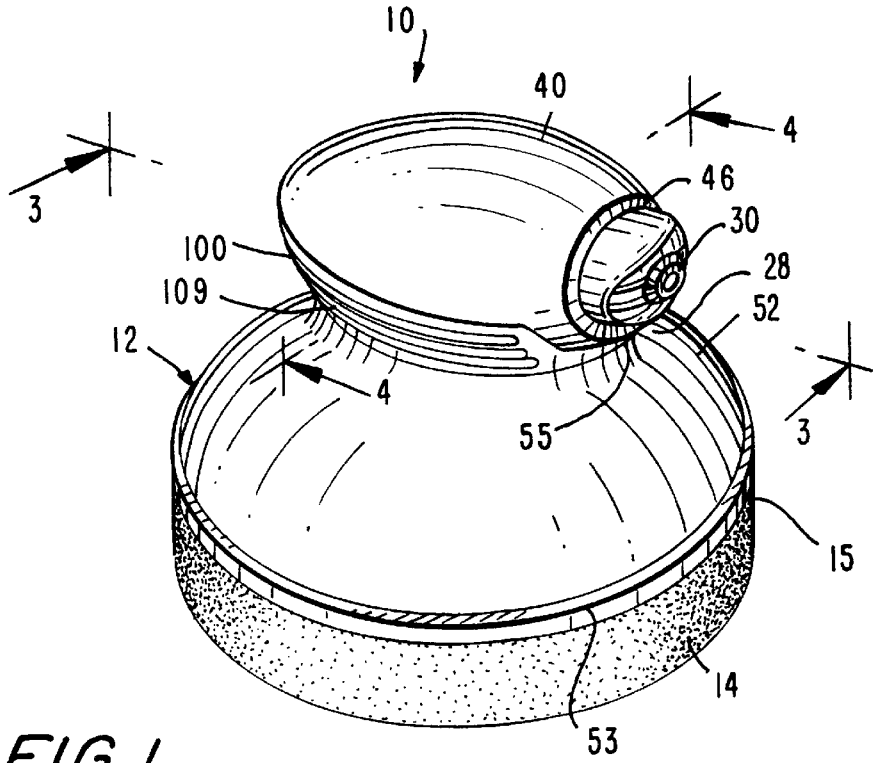
FIG. 1 is a front perspective view of a preferred embodiment of a hand-held applicator for applying a cleaning or polishing solution to a desired surface in accordance with the teachings of the present invention.
Figure 2:
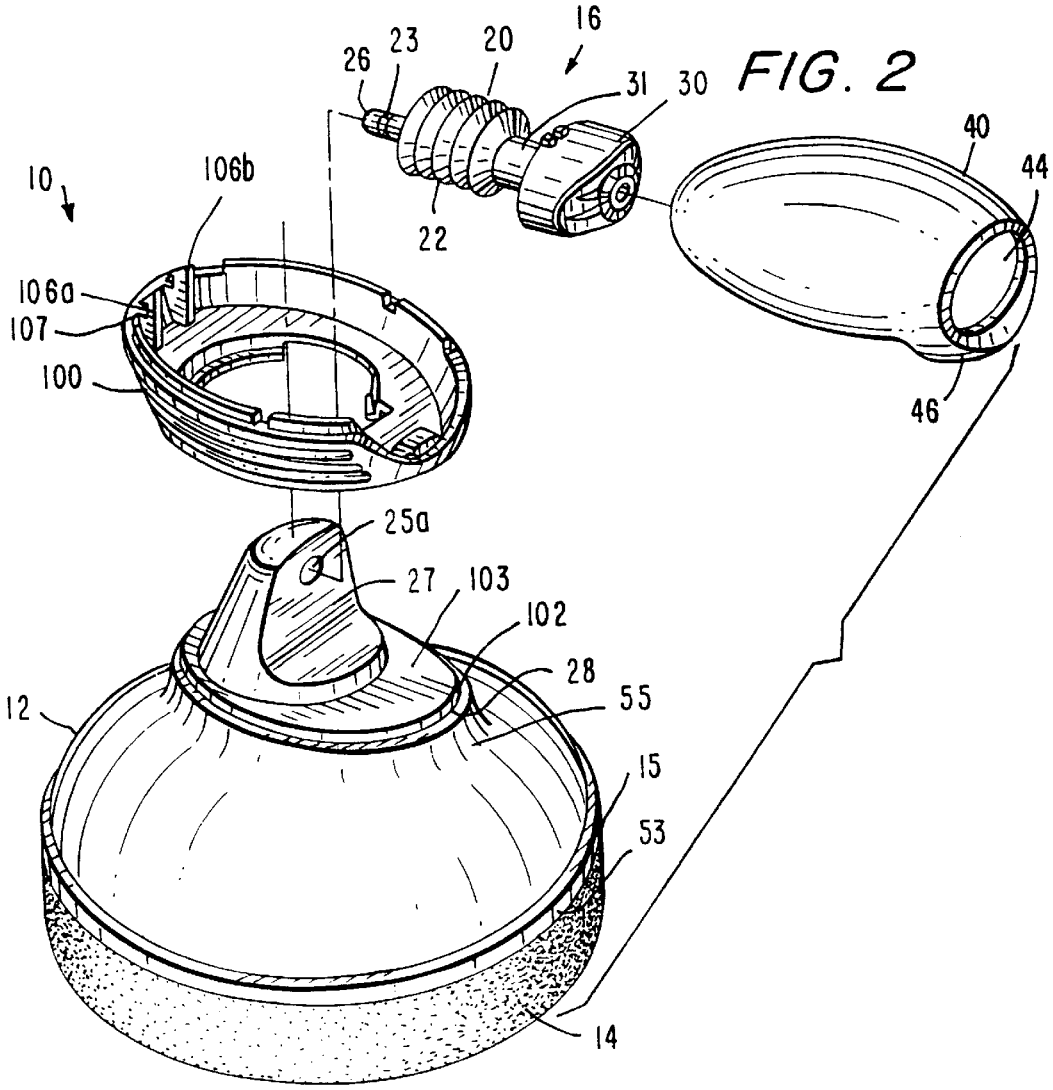
FIG. 2 is an exploded view of the hand-held applicator for applying a cleaning or polishing solution to a desired surface of FIG. 1.

Referring now to the drawings, and specifically to FIGS. 1 and 2 thereof, a hand-held applicator for applying a cleaning or polishing solution to a surface is illustrated wherein the cleaning or polishing solution is contained within the applicator and can be pressure-released directly onto a flat surface and applied with a solution applicator pad attached to the housing. The contemplated use of this applicator is for cleaning or polishing vehicle surfaces, glass, etc.

As is shown in one preferred embodiment illustrated in FIGS. 1 and 2, the hand-held applicator 10 of the present invention includes a container housing 12 for containing the cleaning or polishing solution, a solution applicator pad 14 adhesively or mechanically attached to a base platform ring 15 snap-fit to the container housing 12, and a pump assembly, generally designated by reference numeral 16, which opens a discharge valve assembly 34 due to manual actuation thereof to release a portion of the cleaning or polishing solution contained in the container housing 12 directly to the surface to be cleaned or polished by pressure for application by the solution applicator pad 14.

In this hand-held applicator 10, the container housing 12 is formed of a hard plastic and contains a cleaning or polishing solution 13, such as a cleaning agent, a wax, a protectant, soap, detergent, or the like.

Figure 4:
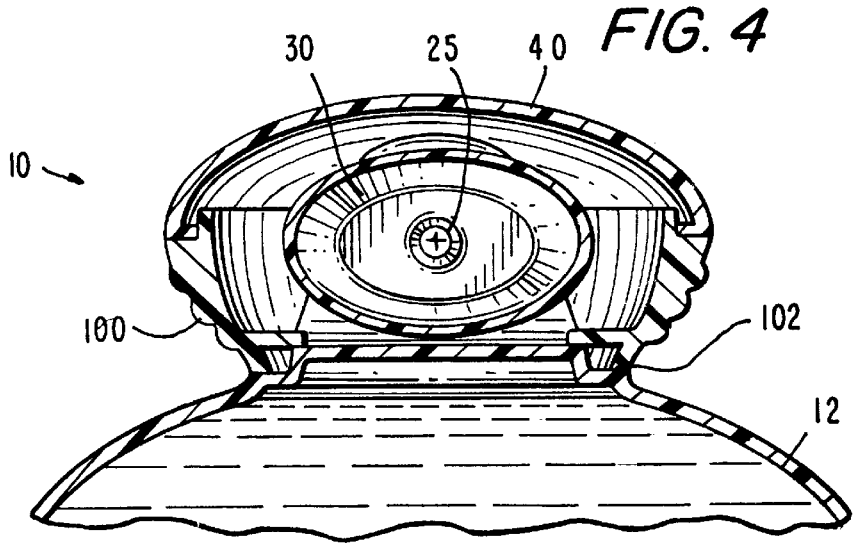
FIG. 4 is a side cross-sectional view of the applicator of FIG. 1 taken along line 4—4 of FIG. 1.
Figure 3:
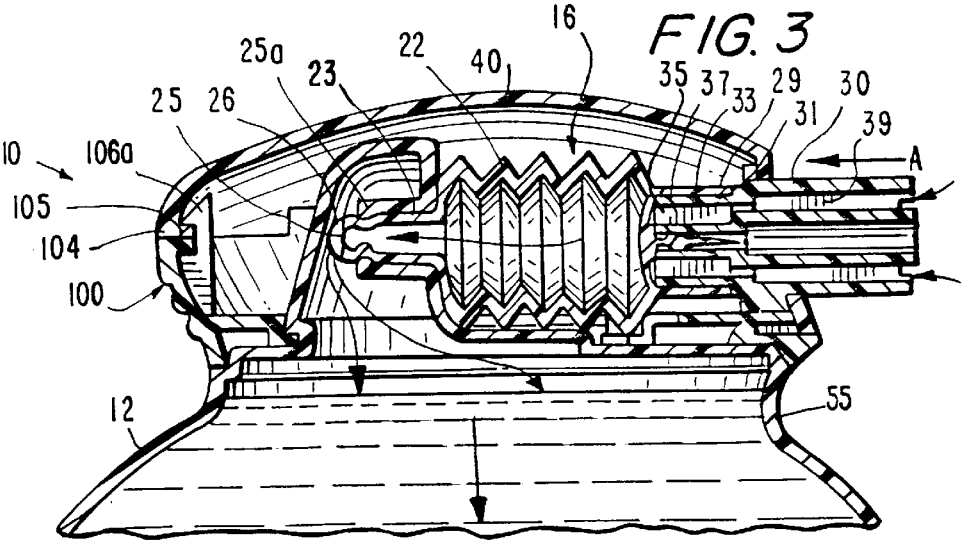
FIG. 3 is a front cross-section view of the applicator of FIG. 1 taken along line 3—3 of FIG. 1 specifically illustrating air flow through the actuating member, pump assembly and container housing.

As is best shown in FIG. 2, the pump assembly 16 is connected to the container housing 12 and includes an air pump 20 for increasing pressure within the container housing 12 to thereby open a discharge valve assembly 34 and release a portion of the cleaning or polishing solution from the container housing 12 directly onto the surface to be cleaned or polished for application by the solution application pad 14 as will be described in more detail below. This air pump 20 is in the form of a bellows-like chamber 22 which communicates with the container housing 12 through an air opening slit 25 provided in a stem member 23 at an end 26 thereof (see FIGS. 3 and 4). As is best shown in FIG. 3, the bellows-like chamber 22 of the pump assembly 16 is connected generally perpendicular to the housing 12. In order to join the bellows-like chamber 22 to the container housing 12, the stem member 23 is fitted into an aperture 25*a* formed in a top neck portion 27 of the container housing 12 so that the air opening slit 25 extends into the interior of the container housing 12 (see FIG. 3).

In order to compress the bellows-like chamber 22 and thereby pressurize the cleaning or polishing solution within the container housing, a thumb-activated actuating member 30 is connected to the bellows-like chamber 22 so as to extend generally horizontally therefrom. More specifically, the thumb-activated actuating member 30 is joined to the bellows-like chamber 22 by means of a plug member 31 inserted into an opening 33 provided at the end 29 of the bellows-like chamber 22 opposite to the stem member 23. A sealing valve 35, preferably in the form of an umbrella valve, is provided at an end 37 of the plug member 31 of the bellows-like chamber 22. As will be described in more detail below, this sealing valve 35 prevents air pressure loss from the bellows-like chamber 22 during the pump stroke as the sealing valve restricts the flow of air through air channel openings 39 provided in the actuating member 30. During the return stroke of the pump assembly, the sealing valve 35 is opened to admit air into the bellows-like chamber from the air channel openings 39 to thereby increase pressure in the bellows-like chamber and accelerate closure of the air opening slit 25. When a manual force is applied to the thumb actuating member 30 in a direction designated by arrow A in FIG. 3 which is generally parallel to the surface being applied with the cleaning or polishing solution, the bellows-like chamber 22 is thereby compressed such that the air lock slit 25 is opened to thereby increase the pressure within the container housing 12.

Figure 5A:
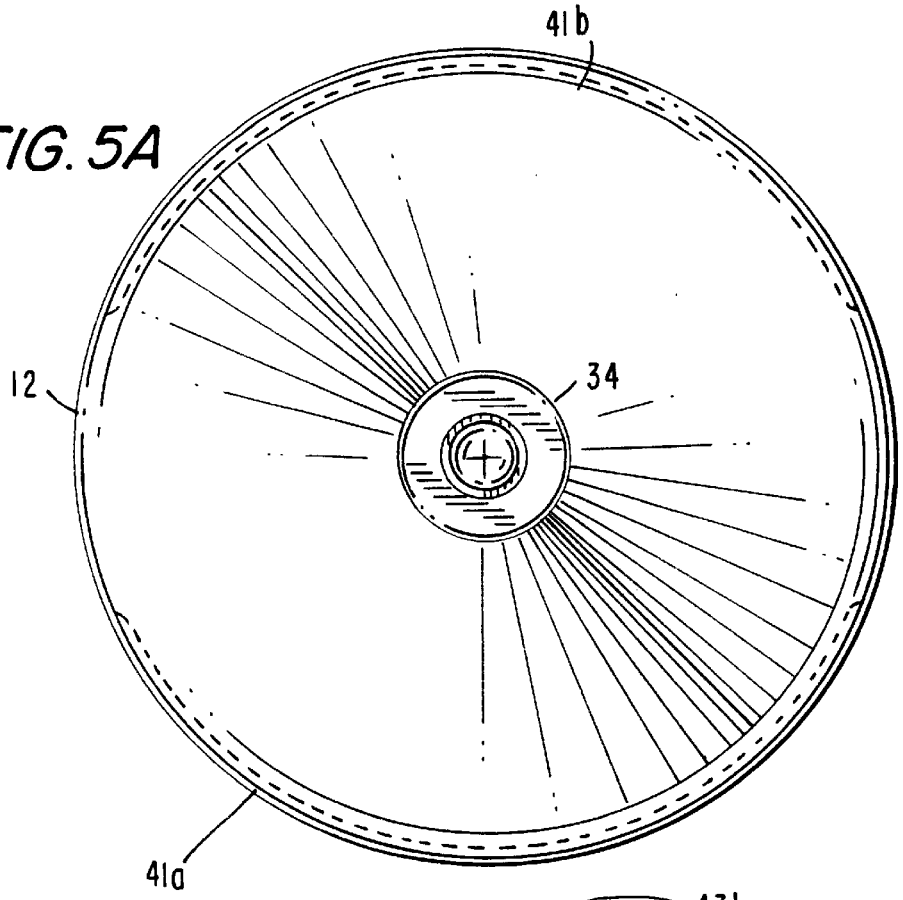
FIG. 5A is a bottom plan view of the container housing and discharge valve assembly of the applicator of FIG. 1 .
Figure 5B:
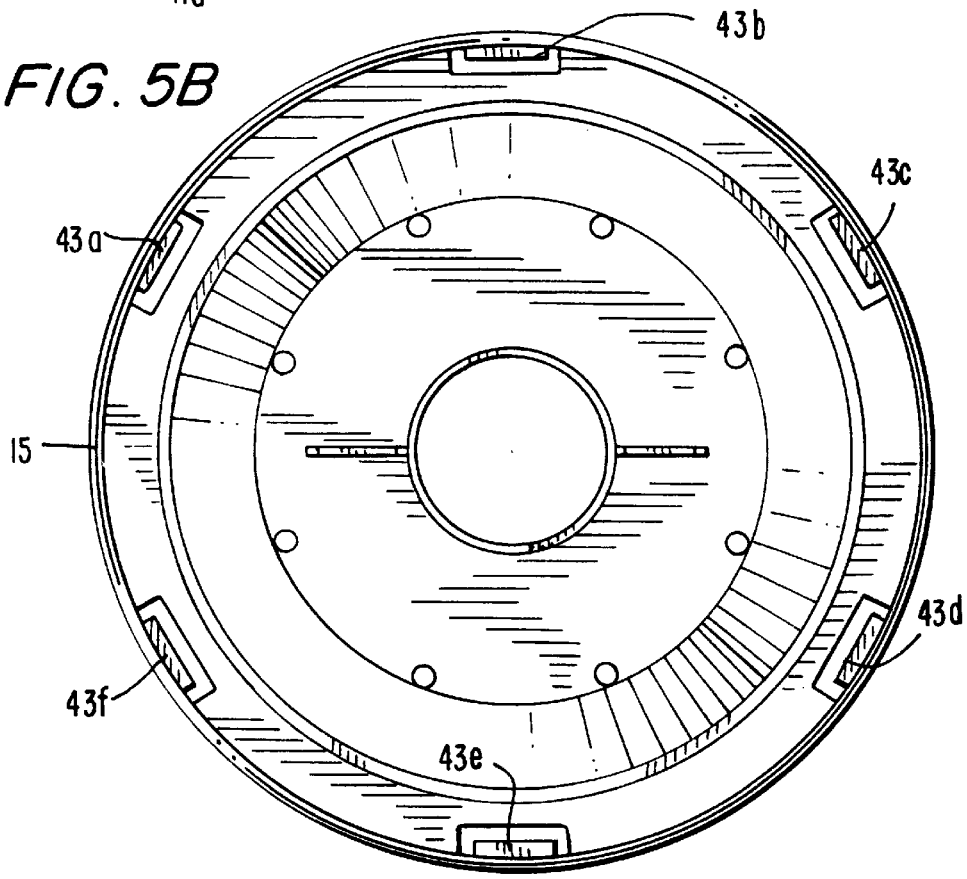
FIG. 5B is a top plan view of the base platform ring of the applicator of FIG. 1.

The solution applicator pad 14 is preferably formed of a porous sponge-like material and is adhesively or mechanically attached to the base platform ring 15 which is snap-fit to the container housing 12. As is best shown in FIG. 5A, the container housing 12 includes a pair of generally semi-circular grooves 41*a* and *b* provided along the outer periphery of the lower portion thereof. The base platform ring 15 includes a plurality of clip retaining members, such as 43*a, b, c, d, e* and *f* (see FIG. 5B), extending inwardly from the inner peripheral edge 45 thereof which snap-fit into the semi-circular grooves 41*a* and 41*b* to reliably retain the base platform ring 15 to the container housing 12.

In order to release a portion of the cleaning or polishing solution from the container housing 12, the discharge valve assembly 34 (see FIGS. 6A–C) is threadly secured to an annular central opening 36 which extends downwardly from the container housing 12 and includes a central aperture 36*a* formed therein. As used herein, the discharge valve assembly 34 can include any type of valving arrangement which releases a portion of the cleaning or polishing solution contained within the container housing only when a desired predetermined pressure is attained in the container housing 12. In one preferred arrangement, the valving arrangement in the discharge valve assembly 34 can be a one-way silicone valve. As a result of this discharge valve assembly, the applicator of the present invention is dripless as cleaning or polishing solution will only be released if the release pressure within the container housing is attained by compression of the bellows-like chamber 22.

Figure 6A:
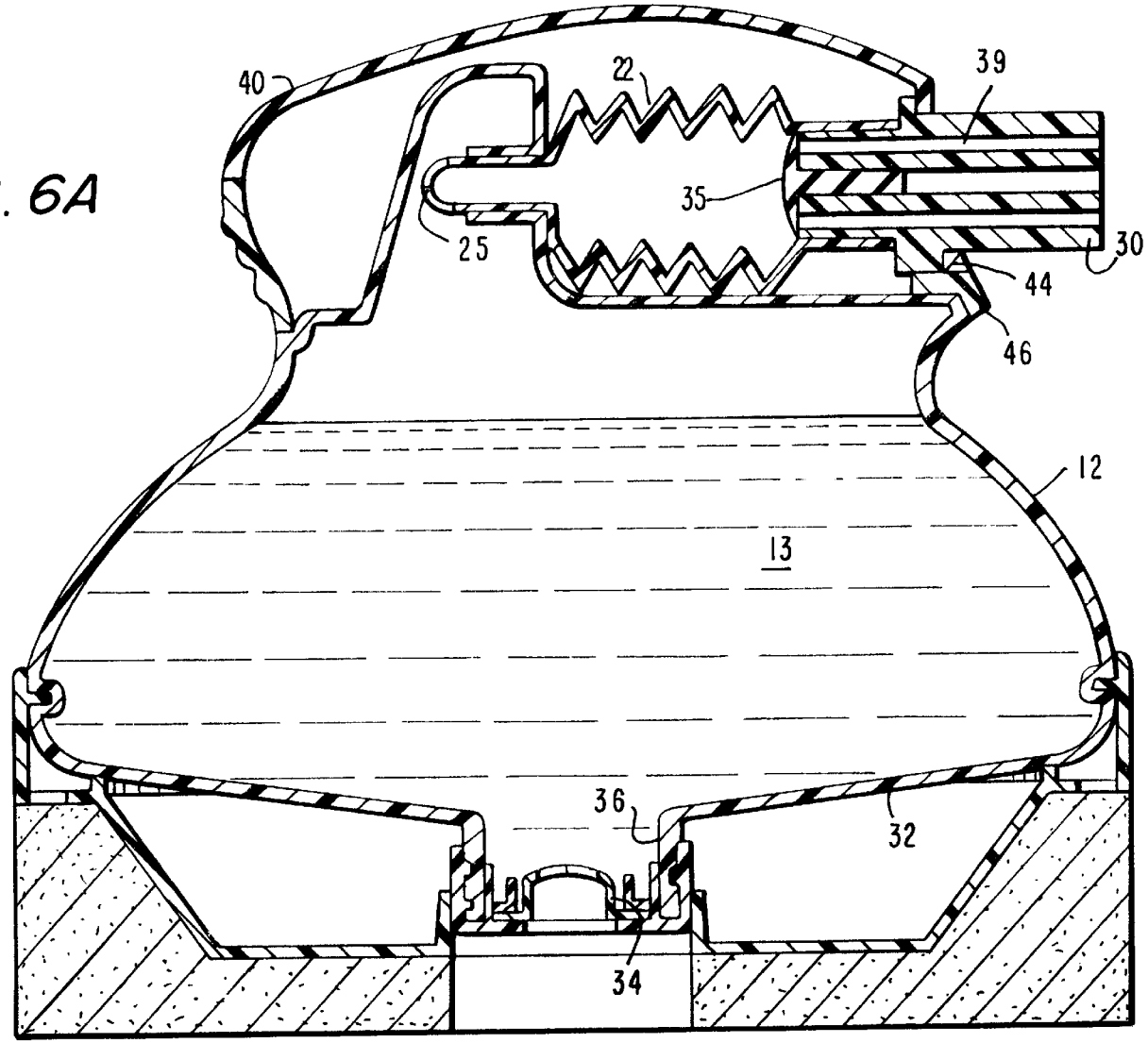
FIG. 6A is a schematic representation illustrating the actuating assembly, pump assembly and discharge valve assembly during the initial position of the applicator of FIG. 1.
Figure 6B:
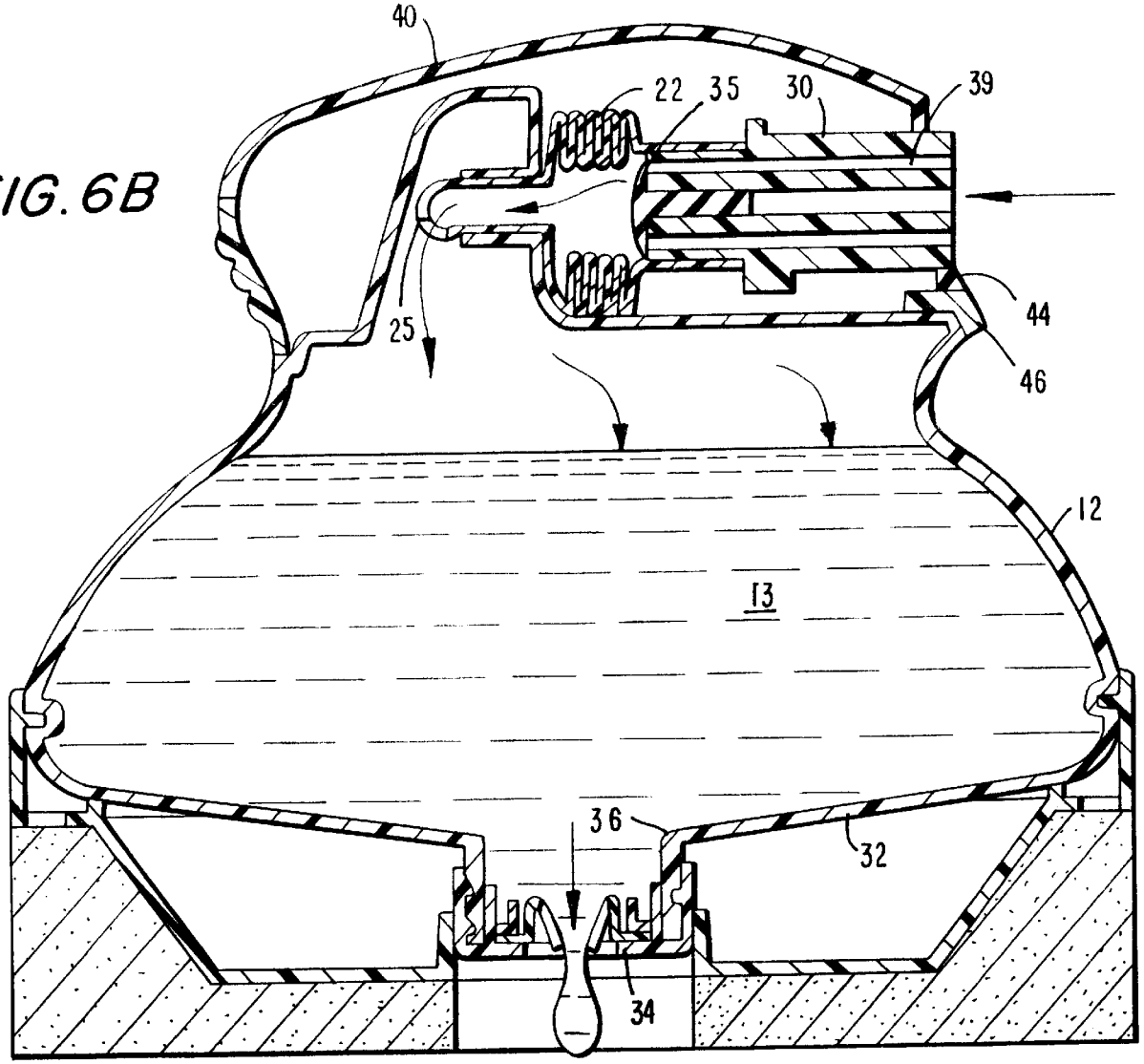
FIG. 6B is a schematic representation illustrating the actuator assembly, pump assembly and discharge valve assembly during the pump stroke of the applicator of FIG. 1.
Figure 6C:
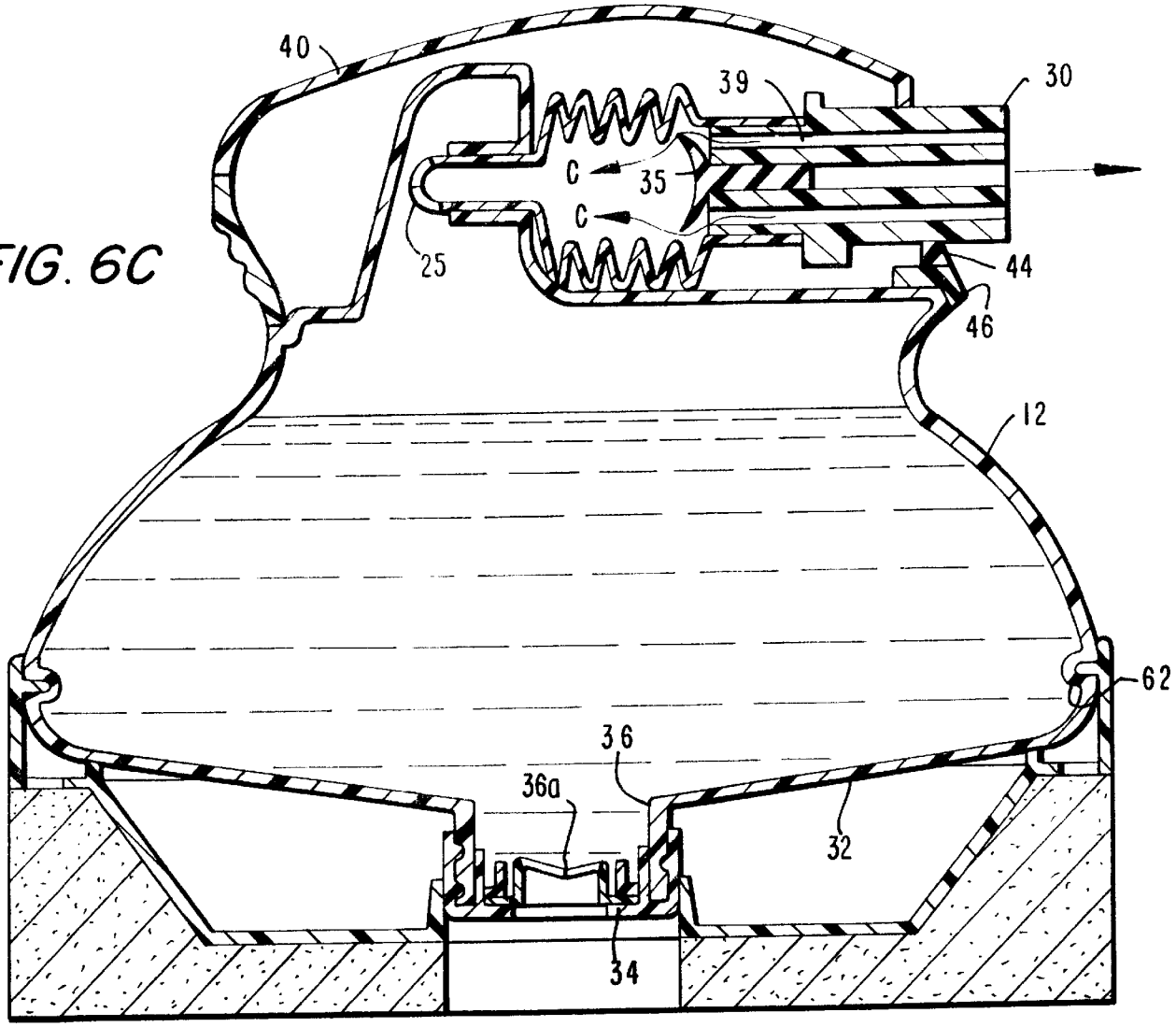
FIG. 6C is a schematic representation illustrating the actuator assembly, pump assembly and discharge valve assembly during the return stroke of the applicator of FIG. 1.

The operation of the applicator 10 to release a portion of the cleaning or polishing solution from the container housing 12 to the surface to be cleaned or polished is shown in FIGS. 6A–C. In the initial rest solution shown in FIG. 1 (the fully retracted position of the thumb actuating assembly 30), the sealing valve 35 of the actuator assembly 30 is closed, the air opening slit 25 of the bellows-like chamber 22 is closed, and the discharge valve assembly 34 is closed such that the cleaning or polishing solution 13 contained within the container housing 12 cannot escape. During the pump stroke as shown in FIG. 6B, the thumb actuating member 30 is depressed inwardly to thereby compress the bellows-like chamber 22 and open the air opening slit 25 so that air can be admitted into the container housing 12 in the direction of the arrows in FIG. 6B. The sealing valve 35 remains closed to prevent air pressure loss through the air channels 39 of the thumb actuating member 30. When the pressure within the container housing reaches a threshold, the discharge valve assembly 34 is opened such that a portion of the cleaning or polishing solution is released directly onto the surface to be cleaned or polished for application by the solution application pad 14. Accordingly, the amount of cleaning or polishing solution which will be released through the valve assembly 34 is dependent upon the pressure applied to the thumb depression member 30 by the user. With the cleaning or polishing solution dispersed thereon, the solution applicator pad 14 cleans or polishes the desired surface as a result of the cleaning or polishing action of the user.

The return stroke is illustrated in FIG. 6C. As the thumb actuating member 30 retracts, the bellows-like chamber 22 expands thereby decreasing its pressure so that the air opening slit 25 is closed. As a result, the pressure within the container housing 12 decreases such that the discharge valve assembly 34 is closed preventing further cleaning or polishing solution to be released therethrough. During the return stroke, the sealing valve 35 is opened to permit air to pass from the air channels 39 into the bellows-like chamber to thereby accelerate expansion of the bellows-like chamber 22 and closure of the air opening slit 25.

As is shown in FIGS. 1 through 4, a cover member 40 protects the pump assembly 20 and the thumb actuating member 30 and maintains the bellows-like chamber 22 and the thumb actuating member 30 in their generally perpendicular relation with respect to the container housing 12 as the thumb actuating member 30 extends through an opening 44 provided along a side edge 46 of the cover member. Therefore, the thumb actuating member 30 can be depressed in the applicator 10 of the present invention even when the cover member 40 is so retained.

A collar member 100 is fitted over the neck portion 27 of the container housing 12 and is secured to a retainer ridge 102 provided on a top horizontal support member 103 of the container housing (see FIG. 2). The collar member 100 also reliably retains the cover member 40 with the bellows-like chamber 22 and thumb depression actuating member 30 being seated therebetween. In order to accomplish this engagement, the inner rear peripheral surface 104 of the cover member 40 includes an inwardly extending rib member 105 which is snap-fit into a pair of retaining clip members 106*a* and *b* extending from the rear inner peripheral surface 107 of the collar member 100. In addition, the front edges of the cover member 40 and collar member 100 are secured to one another. The outer surface of the collar member 100 includes a ribbed section to assist the user in gripping the applicator and enhance maneuverability of the applicator In the embodiment of the hand-held applicator 10 of FIGS. 1 through 6, in order to assist the user in applying the desired manual pressure to the thumb depression member 30 and assist with the desired cleaning or polishing motion, the container housing 12 is formed of a hard plastic material and includes a contoured outer surface 52 extending from the top surface 28 thereof to the bottom surface 53. This contoured outer surface 52 defines a contoured grooved finger control region 55 for the user's hand to facilitate the desired application of the cleaning or polishing solution to the surface. Moreover, in order to facilitate the flow of cleaning or polishing solution to the central opening 36*a* for release through the discharge valve assembly 34, the bottom surface 32 of the container housing 12 is slightly slanted from an outer edge 62 to the central opening 36*a* thereof.

Another preferred embodiment of the hand-held applicator for applying a liquid product to a surface of the present invention is shown in FIGS. 7 through 10 of this application. This applicator is similar in structure and function to the applicator of FIGS. 1 through 6. Accordingly, for the sake of simplification, similar features in the embodiment of FIGS. 7 through 10 will utilize the same reference numeral as that of the applicator of FIGS. 1 through 6 with an apostrophe except for those features specifically set forth herein. For instance, the bellows-like chamber in the embodiment of FIGS. 7 through 10 will be designated by the corresponding reference numeral 22'.

Figure 8:
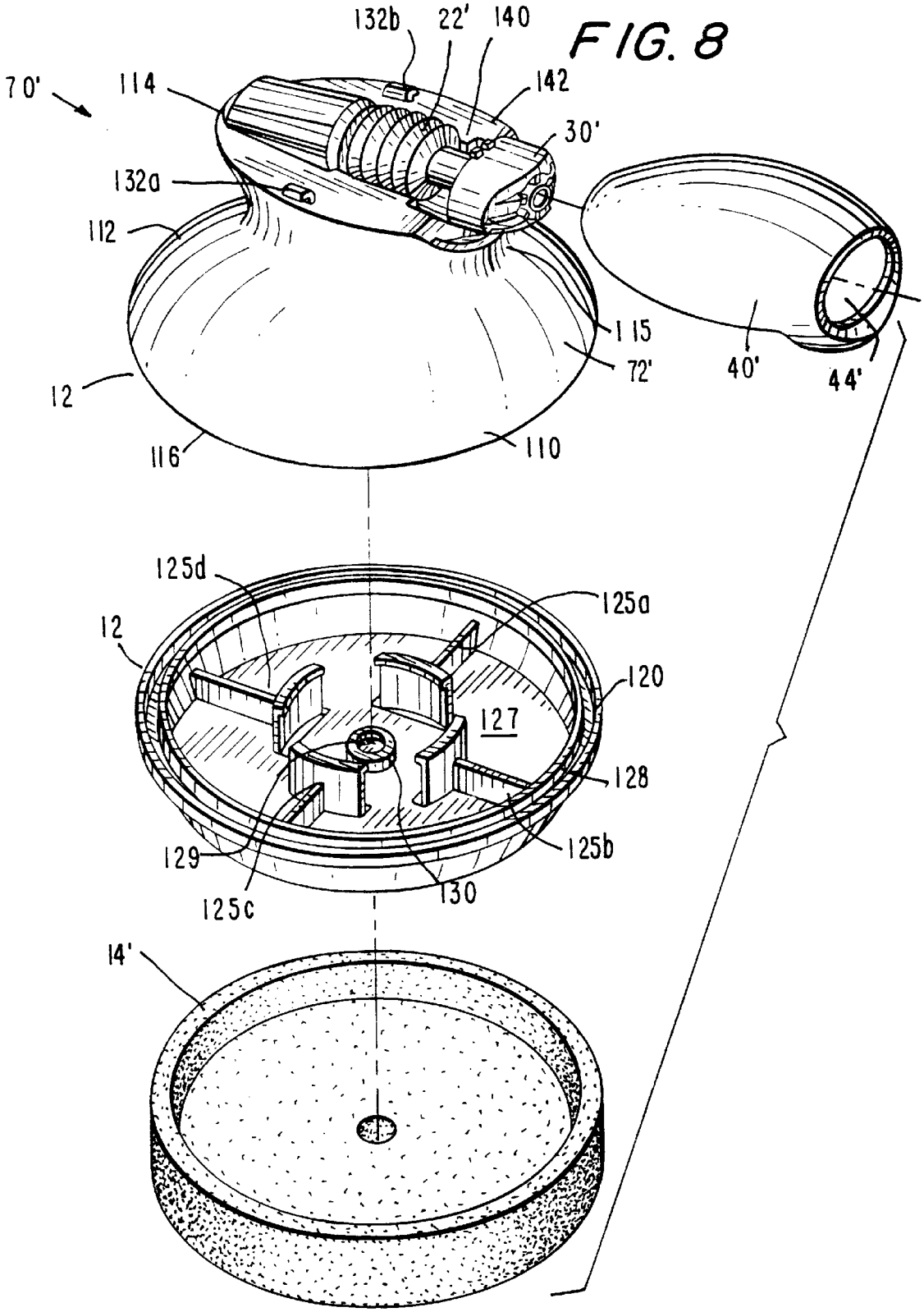
FIG. 8 is an exploded view of the hand-held applicator for applying a cleaning a polishing solution to a desired surface of FIG. 7.

As best shown in FIGS. 7 and 8, the hand-held applicator 70' of the second preferred embodiment includes a two-piece container housing 12' for containing the liquid or polishing solution. The container housing 12' includes a first part 110 and a second part 120 snap-fit to one another. In order to assist the user in applying the desired manual pressure to the thumb depression member 30' and assist with the desired cleaning or polishing motion, the first and second parts 110 and 120 are formed of a hard plastic material and the first part 110 includes a contoured outer surface 112 extending from the top surface 114 to the bottom surface 116 thereof. This contoured outer surface 112 also defines a contoured grooved finger control region 115 for the user's hand to facilitate the desired application of the cleaning or polishing solution to the surface.

In addition, the second part 120 includes a plurality of evenly shaped T-shaped web members, such as 125*a*, 125*b*, 125*c* and 125*d*, which extend upwardly from the bottom surface 127 and extend from outer edge 128 thereof terminating short of the central opening 129 of the discharge valve assembly 130. These T-shaped web members 125*a–d* are support ribs for supporting the bottom surface 127 of the second part 120 of the container housing 12'.

The applicator 70' of FIGS. 7 through 10 does not include the collar member 100 of the applicator 10 of the embodiment of FIGS. 1 through 6. Instead, the container housing 12' includes a plurality of retaining grooves, such as 132*a* and *b*, which reliably retain the cover member 40' in a condition protecting the bellows-like chamber 22' and the thumb actuating member 30'. In this retained condition, the thumb depression actuating member 30' extends outwardly from the central opening 44' of the cover member 40'.

Moreover, in order to reliably retain the bellows-like chamber 22' in its position generally perpendicular to the container housing 12', the bellows-like chamber 22' is seated in a recessed channel 140 formed along the top surface 142 of the container housing 12'.

Figure 9:
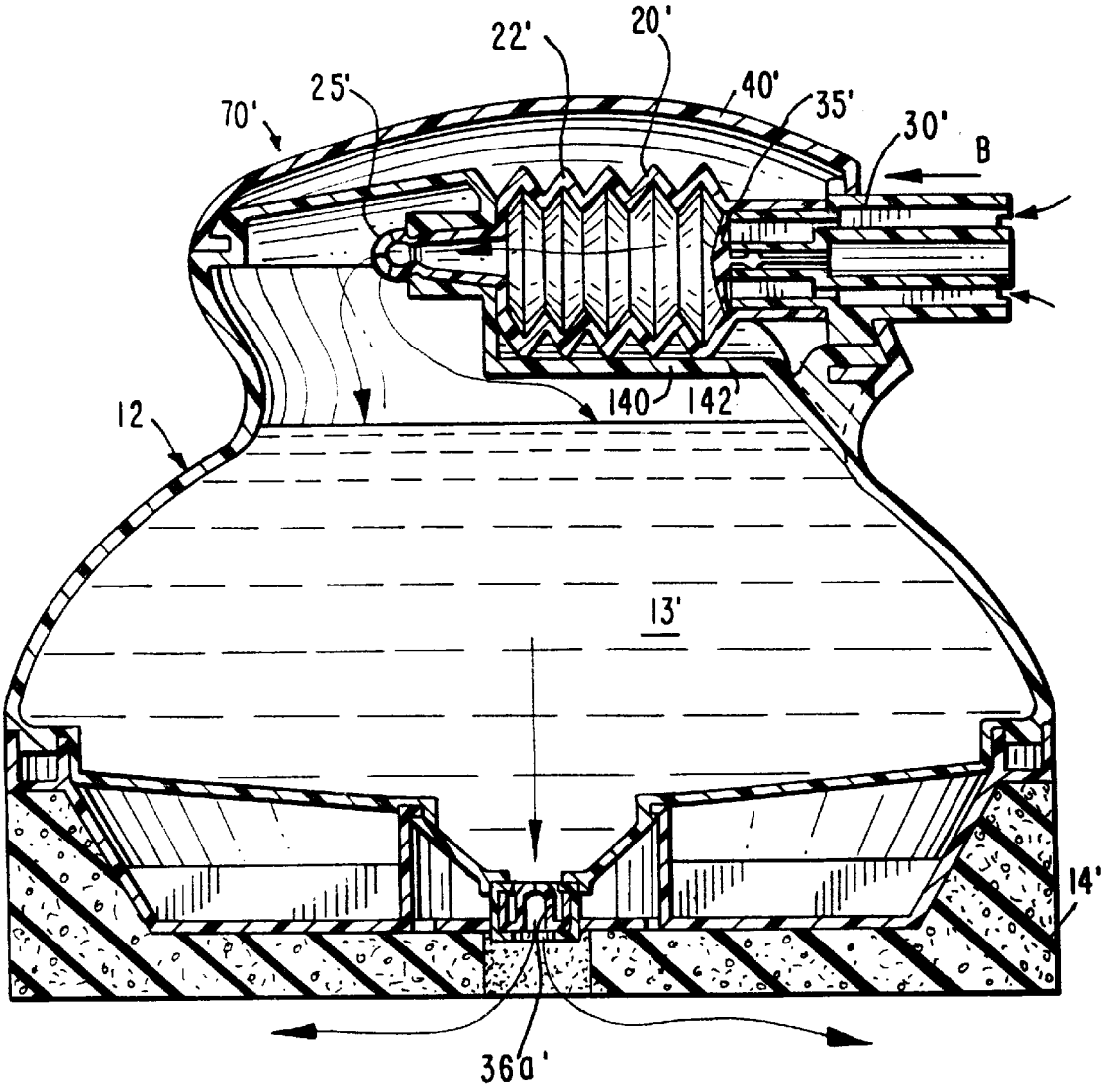
FIG. 9 is a front cross-sectional view of the applicator of FIG. 7 taken along line 9—9 of FIG. 7.

As in the applicator 10 of the embodiment of FIGS. 1 through 6, as shown in FIG. 9, when manual force is applied to the thumb depression member 30 in a direction generally parallel to the surface being applied with the cleaning or polishing solution (see arrow B in FIG. 9), the bellows-like chamber 22' is in turn compressed to thereby open the air opening slit 25' to admit air into the container housing 12' and increase the pressure thereof. The sealing value 35' of the thumb actuating member 30' remains closed to prevent air loss.

As the pressure within the container housing 12' increases, the discharge valve assembly 34' is opened to release a desired amount of cleaning or polishing solution 13' directly onto the surface to be cleaned or polished for application by the solution applicator pad 14' upon the cleaning and polishing action of the user.

Accordingly, an applicator assembly for applying a cleaning or polishing solution has been provided which is dripless, extremely convenient to use, and reduces the cleaning or polishing time of the user as the cleaning or polishing solution can be dispensed onto the desired surface simultaneously with the cleaning and polishing action of the user. In addition, a cost effective design is provided as the air opening slit 25 on the end of the stem member 23 of the bellows-like chamber 22 acts as a valve without the necessity of a separate valve arrangement.

Since both the applicators 10 and 70' include a thumb actuated pump assembly which extends generally perpendicular to the container housing with the container housing including a contoured grooved control region along the outer surface thereof to facilitate movement thereof, the surface can be cleaned or polished without undue fatigue to the user. Additionally, since the user can clean or polish the desired surface by grasping the contoured outer surface of the container housing and the cleaning or polishing solution is dispensed as a result of manual force applied to the depression member, the user's hand does not come into contact with the cleaning or polishing solution. Moreover, since the user can control the pressurization within the container housing by the manual pressure applied to the thumb actuating member and in turn opening and closure of the discharge valve assembly, the amount of cleaning or polishing solution dispensed onto the desired surface can be controlled to thereby avoid waste thereof. Further, the design of this applicator provides for ease in control of the maneuvering of the applicator along the cleaning or polishing surface and the applicator can be utilized in any operating position relative to the surface to be cleaned or polished.

Although the invention has been particularly shown and described with reference to certain preferred embodiments, it will be readily appreciated by those of ordinary skill in the art that various changes and modifications may be made therein without departing from the spirit and scope of the invention. It is intended that the appended claims be interpreted as including the foregoing as well as various other such changes and modifications.

What is claim is:

1. A hand-held applicator for applying a liquid product to a surface comprising:

a container housing for containing the liquid product;

discharge valve means for controlling flow of the liquid from said container housing wherein the liquid product flows from said container housing through said discharge valve means along a central flow axis of said container housing;

pump means for increasing the pressure within said container housing for releasing a portion of the liquid product through said discharge valve means from said container housing wherein said pump means is connected to said container housing generally perpendicular to said central flow axis;

means for actuating said pump means by manual force in a direction generally parallel to the surface being applied with the liquid product wherein said actuating means extends generally perpendicular to said central flow axis of said container housing;

a solution applicator pad for applying the liquid product released through said discharge valve means by a polishing or cleaning action thereof upon the surface; and cover means removably attached at an uppermost portion of said container housing and over said pump means for protecting said pump means during use and for maintaining said pump means actuating means in a generally perpendicular orientation relative to the central flow axis of the container housing as it is depressed and released.

2. The hand-held applicator for applying a liquid product to a surface of claim 1 wherein said pump means is a bellows-like chamber communicating with said container housing through an air opening slit and compressible upon actuation of said pump means actuating means to open said air opening slit and thereby admit air into said container housing and increase the pressure thereof.

3. The hand-held applicator for applying a liquid product to a surface of claim 2 wherein said container housing includes an opening provided at a neck portion thereof into which said bellows-like chamber is fitted so as to extend generally perpendicular to said container housing.

4. The hand-held applicator for applying a liquid product to a surface of claim 1 wherein said container housing includes a contoured outer surface defining a grooved control region for the user's hand to facilitate the desired application of liquid product to the surface.

5. The hand-held applicator for applying a liquid product to a surface of claim 1 wherein said container housing includes an annular central opening at a bottom surface thereof with said discharge valve means being fitted onto said annular central opening of said container housing to communicate with the interior of the container housing.

6. The hand-held applicator for applying a liquid product to a surface of claim 5 wherein said bottom surface of said container housing is slightly slanted from an outer edge thereof to said central opening to facilitate the flow of liquid product contained in said container housing to said central opening.

7. The hand-held applicator for applying a liquid product to a surface of claim 1 wherein said discharge valve means is openable only in response to a predetermined pressurization of said container housing.

8. The hand-held applicator for applying a liquid product to a surface of claim 7 wherein said discharge valve means is a one-way silicone valve.

9. The hand-held applicator for applying a liquid product to a surface of claim 1 and further including a collar member engaging said cover means by a snap-fit connection to ensure protection of said pump means during use and being connected to a retaining ridge provided on a top horizontal support member of said container housing.

10. The hand-held applicator for applying a liquid product to a surface of claim 9 wherein said collar member includes a ribbed outer surface to assist the user in grasping and maneuvering the applicator during use.

11. The hand-held applicator for applying a liquid product to a surface of claim 1 and further including a base support ring snap-fit to a bottom surface of said container housing to which said solution applicator pad is adhesively attached.

12. The hand-held applicator for applying a liquid product to a surface of claim 1 wherein said pump means actuating means includes a sealing valve at the end thereof communicating with said pump means to prevent air loss during the pump stroke of said pump means.

13. The hand-held applicator for applying a liquid product to a surface of claim 12 wherein said sealing valve is an umbrella valve.

14. The hand-held applicator for applying a liquid product of claim 1 wherein the liquid product contained in said container housing is selected from the group consisting of wax, cleaning solution, protectant, soap, and detergent.

15. The hand-held applicator for applying a liquid product to a surface of claim 1 wherein said solution applicator pad is formed of a sponge-like material.

16. A hand-held applicator for applying a liquid product to a surface comprising:

a container housing for containing the liquid product wherein the liquid product contained in said container housing is selected from the group consisting of wax, cleaning solution, protectant, soap and detergent wherein the liquid product flows from said container housing through said discharge valve means along a central flow axis of said container housing;

discharge valve means for controlling flow of the liquid product from said container housing;

pump means for increasing the pressure within said container housing so as to release a portion of the liquid product through said discharge valve means from said container housing wherein said pump means is connected to said container housing generally perpendicular to said central flow axis, said pump means including a bellows-like chamber communicating with said container housing by means of an air opening slit at an end thereof extending into said container housing;

means for actuating said pump means by manual force in a direction generally parallel to the surface applied with the liquid product so as to compress said bellows-like chamber and thereby open said air opening slit to admit air into said container housing to increase the pressure thereof so as to open said discharge valve means and release a portion of the liquid product from the container housing onto the surface wherein said actuating means extends generally perpendicular to said central flow axis of said container housing;

a solution applicator pad for applying the liquid product released through said discharge valve means by a polishing or cleaning action thereof upon the surface; and cover means removably attached at an uppermost portion of said container housing and over said pump means for protecting said pump means during use and for maintaining said pump means actuating means in a generally perpendicular orientation relative to the central flow axis of the container housing as it is depressed and released.

17. The hand-held applicator for applying a liquid product to a surface of claim 16 wherein said bellows-like chamber and said pump means actuating means extend generally perpendicular to said container housing.

18. The hand-held applicator for applying a liquid product to a surface of claim 16 wherein said container housing includes an opening provided at a neck portion thereof into which said bellows-like chamber is fitted so as to extend genarally perpendicular to said container housing.

19. The hand-held applicator for applying a liquid product to a surface of claim 16 wherein said container housing includes a contoured outer surface defining a grooved control region for the user's hand to facilitate the desired application of liquid product to the surface.

20. The hand-held applicator for applying a liquid product to a surface of claim 16 wherein said container housing includes an annular central opening at a bottom surface thereof with said discharge valve means being fitted into said annular central opening of said container housing to communicate with the interior of said container housing.

21. The hand-held applicator for applying a liquid product to a surface of claim 16 wherein said discharge valve pressurization of said container housing.

22. The hand-held applicator for applying a liquid product to a surface of claim 21 wherein said discharge valve means is a one-way silicone valve.

23. The hand-held applicator for applying a liquid product to a surface of claim 16 wherein said pump means actuating means includes a sealing valve at an end thereof communicating with said pump means to prevent air loss during the pump stroke of said pump means.

24. The hand-held applicator for applying a liquid product to a surface of claim 23 wherein said sealing valve is an umbrella valve.

25. The hand-held applicator for applying a liquid product to a surface of claims 16 wherein said solution applicator pad is formed of a sponge-like material.

26. A hand-held applicator for applying a liquid product to a surface comprising:

a container housing for containing the liquid product contained in said container housing wherein the liquid product is selected from the group consisting of wax, cleaning solution, protectant, soap and detergent;

discharge valve means for controlling flow of the liquid product from said container housing wherein said discharge valve means is openable only in response to a predetermined pressurization of said container housing and wherein the liquid product flows from said container housing through said discharge valve means along a central flow axis of said container housing;

pump means for increasing the pressure within said container housing so as to release a portion of the liquid product through said discharge valve means from said container housing wherein said pump means is connected to said container housing generally perpendicular to said central flow axis, said pump means including a bellows-like chamber communicating with said container housing by means of an air opening slit at an end thereof extending into said container housing;

means for actuating said pump means by manual force in a direction generally parallel to the surface being applied with the liquid product so as to compress said bellows-like chamber and thereby open said air opening slit to admit air into said container housing to increase the pressure thereof so as to open said discharge valve means and release a portion of the liquid product from the container housing onto the surface wherein said actuating means extends generally perpendicular to said central flow axis of said container housing, said pump means actuating means including a sealing valve at an end thereof communicating with said bellows-like chamber to prevent air loss during the pump stroke of said pump means;

a solution applicator pad for applying the liquid product released through said discharge valve means by a cleaning or polishing action thereof upon the surface and cover means removably attached at an uppermost portion of said container housing and over said pump means for protecting said pump means during use and for maintaining said pump means actuating means in a generally perpendicular orientation relative to the central flow axis of the container housing as it is depressed and released.

27. The hand-held applicator for applying a liquid product to a surface of claims 26 wherein said discharge valve means is a one-way silicone valve.

28. The hand-held applicator for applying a liquid product to a surface of claim 26 wherein said sealing valve is an umbrella valve.

* * * * *

UNITED STATES PATENT AND TRADEMARK OFFICE
CERTIFICATE OF CORRECTION

PATENT NO. : 6,036,391

DATED : March 14, 2000

INVENTOR(s) : Brian Holliday, Paul Metaxatos and David Mathieu

It is certified that error appears in the above-identified patent and that said Letters Patent is hereby corrected as shown below:

In Claim 21, column 11, line 61, after "valve" insert --means is openable only in response to a predetermined--

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*